US012055040B1

(12) United States Patent
Zeng et al.

(10) Patent No.: US 12,055,040 B1
(45) Date of Patent: Aug. 6, 2024

(54) DIRECTIONAL DRILLING DEVICE AND DRILLING METHOD OF AQUIFER REMEDIATION OF COAL SEAM ROOF

(71) Applicant: CHINA UNIVERSITY OF MINING AND TECHNOLOGY, BEIJING, Beijing (CN)

(72) Inventors: Yifan Zeng, Beijing (CN); Weihong Yang, Beijing (CN); Qiang Wu, Beijing (CN); Xuan Xiao, Beijing (CN); Kai Pang, Beijing (CN); Xinjiang Wei, Beijing (CN); Xue Liu, Beijing (CN); Han Bao, Beijing (CN)

(73) Assignee: CHINA UNIVERSITY OF MINING AND TECHNOLOGY, BEIJING, Beijing (CN)

( * ) Notice: Subject to any disclaimer, the term of this patent is extended or adjusted under 35 U.S.C. 154(b) by 0 days.

(21) Appl. No.: 18/413,509

(22) Filed: Jan. 16, 2024

(30) Foreign Application Priority Data

Jul. 26, 2023 (CN) ..... 202310927469.9

(51) Int. Cl.
*E21B 7/06* (2006.01)

(52) U.S. Cl.
CPC ..... *E21B 7/068* (2013.01); *E21B 7/061* (2013.01); *E21B 7/064* (2013.01)

(58) Field of Classification Search
CPC ..... E21B 7/068; E21B 7/061; E21B 7/064
See application file for complete search history.

(56) References Cited

U.S. PATENT DOCUMENTS 3,903,974 A * 9/1975 Cullen ..... E21B 36/00 175/73
4,456,080 A * 6/1984 Holbert ..... E21B 17/1078 175/323
4,699,224 A 10/1987 Burton
4,880,067 A * 11/1989 Jelsma ..... E21B 4/02 175/320

(Continued)

FOREIGN PATENT DOCUMENTS

CN 1124515 A 6/1996
CN 109162642 A 1/2019

(Continued)

OTHER PUBLICATIONS

First Office Action issued in counterpart Chinese Patent Application No. 202310927469.9, dated Jan. 25, 2024.

*Primary Examiner* — Taras P Bemko
(74) *Attorney, Agent, or Firm* — Westbridge IP LLC

(57) ABSTRACT

A curvature controllable directional drilling device is disclosed. The drilling device includes: a drill bit, a power unit, a rigid bending unit, a bendable outer wall, and a wedge deflection tool. The power unit is to provide a rotary power to the drill bit. The rigid bending unit is set between the drill bit and the power unit, to bend on a basis of an initial curvature under an external force. The bendable outer wall is set on an outer side of the power unit and the rigid bending unit. The wedge deflection tool is set at one end of the bendable outer wall near the drill bit, to receive a reaction force and bend the rigid bending unit. By a coordination between the wedge deflection tool and the power unit, a drilling direction of the drill bit connected to the rigid bending unit can be adjusted.

6 Claims, 7 Drawing Sheets

(56) References Cited

U.S. PATENT DOCUMENTS

| | | | | |
|---|---|---|---|---|
| 5,050,692 | A * | 9/1991 | Beimgraben | E21B 7/067 175/256 |
| 5,423,389 | A * | 6/1995 | Warren | E21B 7/04 175/75 |
| 5,520,256 | A | 5/1996 | Eddison | |
| 5,727,641 | A * | 3/1998 | Eddison | E21B 7/068 175/76 |
| 6,659,202 | B2 * | 12/2003 | Runquist | E21B 4/16 175/107 |
| 6,698,535 | B1 * | 3/2004 | Morris | E21B 7/06 175/45 |
| 2020/0240212 | A1 * | 7/2020 | Von Gynz-Rekowski | E21B 7/068 |

FOREIGN PATENT DOCUMENTS

| | | | |
|---|---|---|---|
| CN | 114016910 | A | 2/2022 |
| CN | 114075926 | A | 2/2022 |
| CN | 114687669 | A | 7/2022 |
| CN | 115247535 | A | 10/2022 |

* cited by examiner

200

500

DIRECTIONAL DRILLING DEVICE AND DRILLING METHOD OF AQUIFER REMEDIATION OF COAL SEAM ROOF

CROSS-REFERENCE TO RELATED APPLICATIONS

This application claims priority to Chinese Patent Application No. 202310927469.9, filed on Jul. 26, 2023, the content of which is incorporated herein by reference in its entirety.

TECHNICAL FIELD

The disclosure relates to drilling technologies, in particular to a directional drilling device and a drilling method of the directional drilling device of aquifer remediations of a coal seam roof.

BACKGROUND

Directional drilling technologies have a wide range of applications, such as, natural gas extractions, formation grouting reinforcements, water explorations and grouting drillings. In terms of natural gas extractions and grouting drillings, directional drilling technologies can reduce disturbances to formations, and can improve a production efficiency. In this way, a small-scale directional extraction and grouting can be achieved. Moreover, production costs can also be greatly reduced.

Moreover, the directional sidetracking technology involves installing specialized steering and lateral propulsion devices in a borehole to control a drill bit to move in a desired direction. However, the complexity of a directional sidetracking device is relatively high and it is quite difficult in controlling the directional sidetracking device.

SUMMARY

The present disclosure provides a directional drilling device and a drilling method of the directional drilling device. By the directional drilling device and the drilling method, a curvature of an inclined section drilled can be controlled. The directional drilling device and a drilling method can be used for aquifer remediations of a coal seam roof.

The directional drilling device according to examples of the present disclosure may include: a drill bit; a power unit, for providing a rotary power to the drill bit; a rigid bending unit, set between the drill bit and the power unit, for bending on a basis of an initial curvature under an external force; a bendable outer wall, set on an outer side of the power unit and the rigid bending unit; a wedge deflection tool, set at one end of the bendable outer wall near the drill bit, for receiving a reaction force from a wall of a borehole which is perpendicular to an axial direction of the bendable outer wall and for bending the rigid bending unit.

Based on a same concept, the drilling method of the directional drilling device according to the present disclosure may include:

- determining a hardness of a formation of an inclined section based on geological data;
- determining a size of a wedge deflection tool of the directional drilling device based on the hardness and a curvature of the inclined section;

- in response to determining the directional drilling device has reached a lateral drilling point, activating a power unit of the directional drilling device;
- activating a top drive unit of the directional drilling device;
- providing a propulsion force to a rigid bending unit of the directional drilling device;
- changing a bending degree of the rigid bending unit by the wedge deflection tool under an action of the propulsion force and a reaction force from a surface of the formation.

From the above description, it can be seen that the directional drilling device and the drilling method provided by the present disclosure utilize a combination of the wedge deflection tool and the top driving unit to provide a further bending force on the rigid bending unit on the basis of the initial curvature, which may control a drilling direction of the drill bit connected to the rigid bending unit. In this way, a lateral branch drilling without casing or window opening in a vertical borehole can be achieved.

BRIEF DESCRIPTION OF THE DRAWINGS

In order to describe technical solutions of the present application or related arts more clearly, accompanying drawings required for describing examples or the related art are introduced briefly in the following. Apparently, the accompanying drawings in the following descriptions only illustrate some examples of the present application, and those of ordinary skill in the art may still derive other drawings from these drawings without creative efforts.

DETAILED DESCRIPTION OF THE EMBODIMENTS

Hereinafter, in order to make the objective(s), technical solution(s) and advantages of the present application clearer and more understandable, the present application will be further described in detail, in connection with specific embodiments and with reference to the accompanying drawings.

It is necessary to be noted that the technical terms or scientific terms used in the embodiments of the present application should have common meanings as understood by those skilled in the art of the present application, unless otherwise defined. The "first", "second" and similar words used in the embodiments of the present application do not refer to any sequence, number or importance, but are only used to distinguish different component portions. The "comprise", "include" or a similar word means that an element or item before such word covers an element or item or any equivalent thereof as listed after such word, without excluding other elements or items. The "connect" or "interconnect" or a similar word does not mean being limited to a physical or mechanical connection, but may include a direct or indirect electrical connection. The "upper", "lower", "left" and "right" are used only to indicate a relative position relation, and after the absolute position of the described object is changed, the relative position relation may be changed accordingly.

Figure 1:
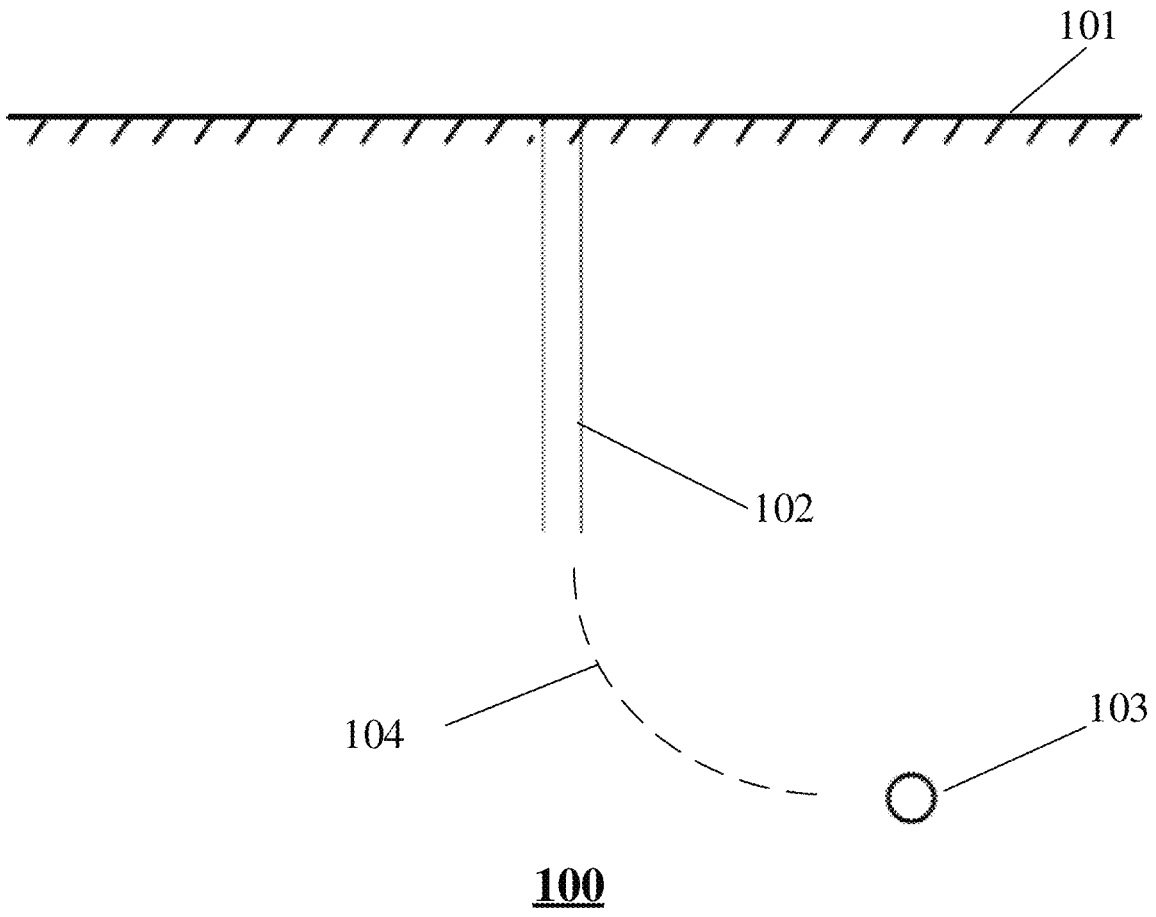
FIG. 1 is a diagram illustrating an application scenario of a directional drilling according to an example of the present disclosure.

As discussed in the background, directional drilling technologies have a wide range of applications. FIG. 1 is a diagram illustrating an application scenario of the directional drilling according to an example of the present disclosure. As shown in FIG. 1, in a directional drilling scenario 100, a vertical borehole 102 is drilled downwards from the ground 101. In order to start a horizontal drilling at a target position 103, it is necessary to form an inclined section 104 between the vertical borehole 102 and the target position 103. The inclined section 104 connects the vertical borehole 102 and the target position 103 and facilitates the horizontal drilling. In the petroleum industry, a dual rotation technology or a single rotation technology can be used to achieve a directional sidetracking. By the dual rotation technology, the direction and the deviation angle of the drill bit can be controlled through two rotating mechanisms. By the single rotation technology, the direction and the deviation angle of the drill bit can be controlled through one rotating mechanism.

However, the technical solution of using rotating mechanisms and a lateral propulsion device to form the inclined section 104 is not only complex, but also imposes significant requirements on the performance of the drilling device, which results in high costs and high technical difficulties.

In view of the above description, a directional drilling device and a drilling method of the directional drilling device are provided in the present disclosure. The directional drilling device can control a curvature of the drilling direction, that is, a curvature of the inclined section 104. In the directional drilling device, a combination of a wedge deflection tool and a top driving unit is utilized to provide a further bending force on a rigid bending unit on the basis of an initial curvature of the rigid bending unit. Under the action of the bending force, the drilling direction of the drill bit connecting to the rigid bending unit can be controlled. In this way, a lateral branch drilling without casing or window opening in a vertical borehole 102 can be achieved.

It should be noted that the directional drilling device can control the curvature of the inclined section 104.

Figure 2:
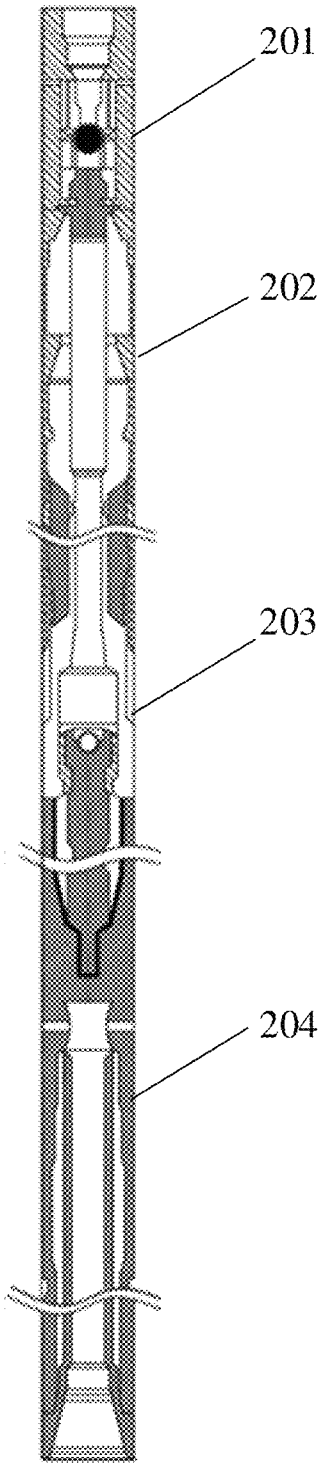
FIG. 2 is a schematic diagram illustrating a structure of a screw drill according to an example of the present disclosure.

In order to achieve a lateral branch drilling, it is necessary to provide a power source for rotations of the drill bit. FIG. 2 is a schematic diagram illustrating a structure of a screw drill according to an example of the present disclosure. The screw drill 200 can convert the hydraulic energy into the mechanical energy, which may drive the drill bit to rotate and drill. That is, the screw drill 200 can provide a rotary power for the drill bit.

As shown in FIG. 2, the screw drill 200 may include a bypass valve 201, a hydraulic motor 202, a universal joint shaft 203 and a transmission core shaft 204. The bypass valve 201, the hydraulic motor 202, the universal joint shaft 203 and the transmission core shaft 204 are sequentially connected.

In some examples, the bypass valve 201 may include a valve body, a valve sleeve, a valve core and a spring. In some examples, the hydraulic motor 202 may include a stator and a rotor.

In a working state, high-pressure drilling fluid can be transported through a continuous pipe to the bypass valve 201 of the screw drill 200. Under a pressure of the high-pressure drilling fluid, the valve core may slide in the valve sleeve, and the movement of the valve core may change a flowing direction of the drilling fluid. When a flow rate and a pressure of the drilling fluid reach a set value, the valve core may move down and close the bypass valve 201. At this time, the drilling fluid may flow through the hydraulic motor 202, which converts the pressure energy into the mechanical energy. The rotor and the stator of the hydraulic motor 202 intermesh with each other. A deviation in lead between the rotor and the stator can form a spiral sealing chamber to complete the energy conversion.

The universal joint shaft 203 may convert a planetary motion of the hydraulic motor 202 into a fixed axis rotation of the transmission core shaft 204 and transmit a torque and a speed generated by the hydraulic motor 202 to the transmission core shaft 204.

Next, the transmission core shaft 204 may transmit the rotary power of the hydraulic motor 202 to the drill bit, while bearing axial and radial loads generated by a drilling pressure.

Figure 3A:
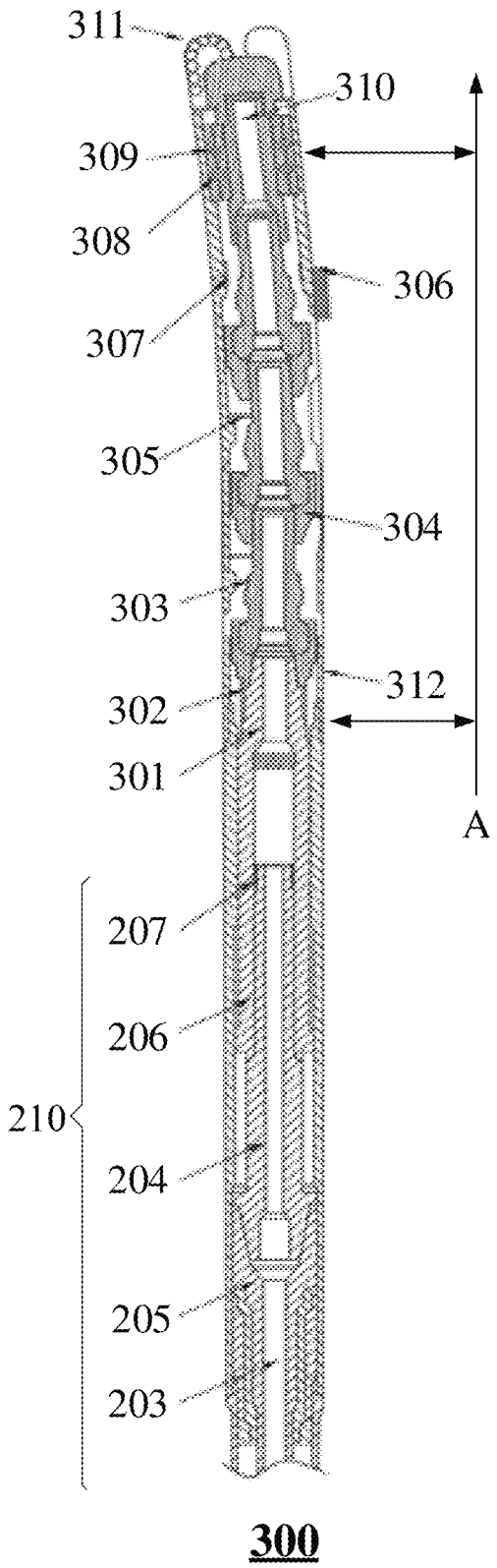
FIG. 3A is a schematic diagram illustrating a cross-section of a directional drilling device according to an example of the present disclosure.

In some examples, as shown in FIG. 3A, the transmission core shaft 204 may connect to the universal joint shaft 203 through a connecting sleeve 205. One end of the transmission core shaft 204 away from the universal joint shaft 203 can be equipped with a sealing ring 207. In some examples, the sealing ring can be an "O"-shaped sealing ring.

The distance between the inclined section 104 and the ground 101 may be tens or hundreds of meters. Therefore, multiple extension rods can be set between the directional drilling device and the ground as needed. In some examples, the extension rod extending to the ground may include a directional scale to indicate the bending direction of the initial curvature of the rigid bending unit. It should be noted that the extension rods do not rotate with the drill bit.

Next, on the basis that the screw drill 200 may provide a rotary power for the drill bit, the present disclosure also provides a directional drilling device. To be noted, the directional drilling device can be used for aquifer remediations of a coal seam roof.

FIG. 3A shows a cross-section of a directional drilling device according to an example of the present disclosure. If the transmission core shaft 204 connects to the drill bit 311 directly, the drill bit 311 may only drill in an extension direction of the transmission core shaft 204, therefore, the lateral drilling cannot be achieved. In view of this, according to some examples of the present disclosure, the directional drilling device 300 is equipped with a rigid bending unit between the transmission core shaft 204 and the drill bit 311. The rotary power of the screw drill 200 can be transmitted to the drill bit 311 through the rigid bending unit. Moreover, in this process, different degrees of bending may be generated under external forces. Therefore, the drilling direction of the drill bit 311 can be adjusted. That is to say, the rigid bending unit can generate a certain amount of bending while rotating.

The initial state of the rigid bending unit is curved. As shown in FIG. 3A, a ray A represents the direction parallel to the axial direction of the transmission core shaft 204. The distance between the end of the rigid bending unit near the transmission core shaft 204 and the ray A is smaller than the distance between the end of the rigid bending unit near the drill bit 311 and the ray A.

In order for the rigid bending unit to further bend on the basis of the initial curvature, it is necessary to apply a force corresponding to the bending direction of the initial curvature to the rigid bending wedge deflection tool continuously. Considering that the rigid bending unit needs to generate a certain degree of bending while rotating, in some examples, the directional drilling device may further include a bendable outer wall 312 and a wedge deflection tool 306 set at one end of the bendable outer wall 312 near the drill bit 311. Optionally, the wedge deflection tool 306 may refer to a gasket with a certain thickness.

Here, the bendable outer wall 312 can bend with the rigid bending unit but not rotate around its axis. In this way, the wedge deflection tool 306 set at one end of the bendable outer wall 312 can receive a reaction force perpendicular to an axial direction of the bendable outer wall 312 from the wall of the borehole. The reaction force may act on the rigid bending unit.

Optionally, the bendable outer wall 312 may include multiple short sections. Adjacent short sections may connect to each other and deflect at a certain angle relative to the axial direction of the rigid bending unit. This approach helps to facilitate the bending of the bendable outer wall 312. Those skilled in the art may use other structures that can bend to form the bendable outer wall 312, which is not limited by this disclosure.

In some examples, the bendable outer wall 312 can be provided on the outer surface of the screw drill 200 and the rigid bending unit.

Figure 3B:
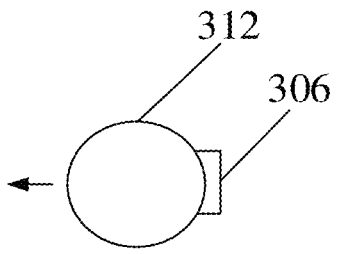
FIG. 3B is a schematic diagram illustrating a structure of a wedge deflection tool according to an example of the present disclosure.
Figure 3C:
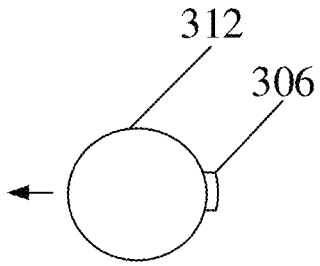
FIG. 3C is a schematic diagram illustrating a structure of a wedge deflection tool according to another example of the present disclosure.
Figure 7:
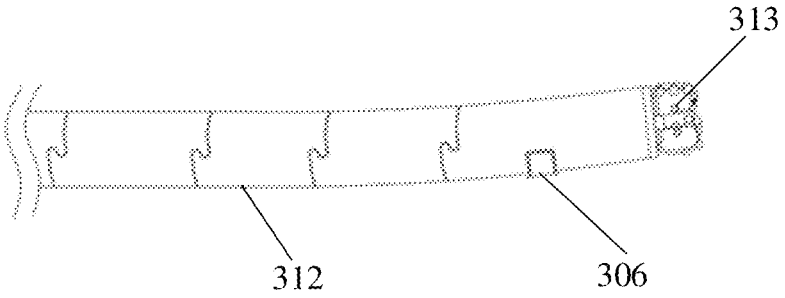
FIG. 7 is a schematic diagram illustrating a structure of the directional drilling device according to an example of the present disclosure.

FIG. 3B is a schematic diagram illustrating a structure of a wedge deflection tool according to an example of the present disclosure. FIG. 3C is a schematic diagram illustrating a structure of a wedge deflection tool according to another example of the present disclosure. FIG. 7 is a schematic diagram illustrating a structure of the directional drilling device according to an example of the present disclosure.

As shown in FIGS. 3A to 3C and 7, the wedge deflection tool 306 can be installed on the outer surface of the bendable outer wall 312, and the wedge deflection tool 306 may protrude from the bendable outer wall 312. This approach is beneficial for the wedge deflection tool 306 to compress the wall of the borehole and therefore obtain a reaction force perpendicular to the axis of the bendable outer wall 312.

Optionally, the position of the wedge deflection tool 306 may deviate from the bending direction of the initial curvature. For example, in FIGS. 3B and 3C, the arrows point towards an initial bending direction of the bendable outer wall 312. The wedge deflection tool 306 is set on a side away from the bending direction. In this way, a force perpendicular to the axial direction of the bendable outer wall 312 may be applied to the bendable outer wall 312 and the rigid bending unit set inside the bendable outer wall 312 based on the reaction force from the wall of the borehole by the wedge deflection tool 306. The direction of the force is consistent with the direction of the initial curvature which enables the rigid bending unit further bend on the basis of the initial curvature.

Optionally, as shown in FIG. 3B, an extension surface of the wedge deflection tool 306 away from the outer surface of the bendable outer wall 312 can be a plane. As shown in FIG. 3C, the extension surface of the wedge deflection tool 306 away from the outer surface of the bendable outer wall 312 can be a curved surface. It should be noted that the extension surface is relative to a contact surface between the wedge deflection tool 306 and the bendable outer wall 312. For example, as shown in FIG. 3C, the wedge deflection tool 306 can be an arc-shaped sheet. As shown in FIG. 3B, the wedge deflection tool 306 can be an arc-shaped concave rectangular prism or the like. The arc-shaped concave rectangular prism refers to a cuboid with one of its six faces being an arc-shaped surface.

In some examples of the present disclosure, the rigid bending unit may have both a certain degree of rigidity and a certain degree of flexibility. In this way, requirements on inclination can be met without any needs of high-quality components. Next, a detailed introduction will be given to the rigid bending unit. As shown in FIG. 3A, in some examples, the rigid bending unit may include a first conversion joint 301, multiple drill rods 303, multiple directional boots 304, and a second conversion joint 310.

In these examples, one end of the first conversion joint 301 can connect to the transmission core shaft 204 through the transmission sleeve 206, and the other end can connect to a first drill rod 303. One end of the second conversion joint 310 can connect to a second drill rod 303, and the other end can connect to the drill bit 311.

Examples of specific connections between the first conversion joint 301, the drill rods 303 and the second conversion joint 310 are provided as the following.

One end of the first conversion joint 301 can be connected and locked to the transmission sleeve 206 through a first locking pin. The other end of the first conversion joint 301 can be connected and locked to the first drill rod 303 through a second locking pin.

One end of the second conversion joint 310 can be connected and locked to the second drill rod 303 through a third locking pin. The other end of the second conversion joint 310 can be connected and locked to the drill bit 311 through a fourth locking pin.

Optionally, thrust bearings 308 and roller bearings 309 can be provided both in the middle of the second conversion joint 310 and on the side of the second conversion joint 310 near the drill bit 311. Among them, the thrust bearings 308 may be used to withstand the axial force brought by the high-pressure drilling fluid, while the roller bearings 309 may serve as fixed shafts to support rotations of the drill bit 311.

Under external forces, the rigid bending unit can further bend. In this way, the drilling direction of the drill bit 311 can be adjusted. Therefore, a lateral drilling can be ultimately achieved.

Given the needs for a further bending of the rigid bending unit, in some examples, the number of the drill rods 303 can be multiple. Adjacent two drill rods 303 can be connected by a directional boot 304. Further, bending spaces may be left between the directional boots 304 and the drill rods 303 to allow changes in an extension directions of adjacent drill rods 303.

Figure 4A:
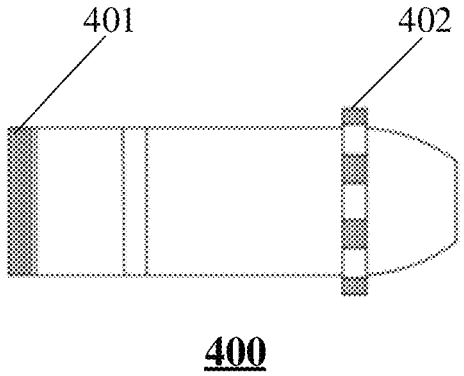
FIG. 4A is a schematic diagram illustrating a structure of a drill rod according to an example of the present disclosure.
Figure 4B:
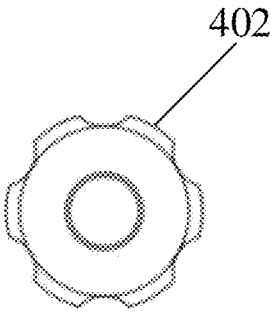
FIG. 4B is a schematic diagram of a side view of the drill rod of FIG. 4A.

FIG. 4A is a schematic diagram illustrating a structure of a drill rod according to an example of the present disclosure. FIG. 4B is a schematic diagram illustrating a side view of the drill rod of FIG. 4A. As shown in FIGS. 4A and 4B, the drill rod 400 may include a first screw thread 401 and a first ring buckle 402. For example, the first ring buckle 402 can be a protrusion arranged around the outer circumference of the drill rod 400.

Figure 5A:
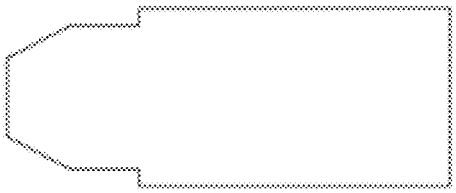
FIG. 5A is a schematic diagram illustrating a structure of a directional boot according to an example of the present disclosure.
Figure 5B:
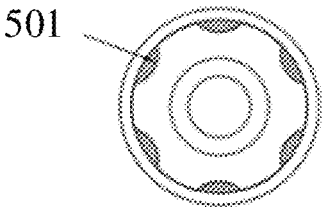
FIG. 5B is a schematic diagram of a side view of the directional boot of FIG. 5A.

FIG. 5A is a schematic diagram illustrating a structure of a directional boot according to an example of the present disclosure. FIG. 5B is a schematic diagram illustrating a side view of the directional boot of FIG. 5A. As shown in FIGS. 5A and 5B, the directional boot 500 may include a second screw thread (not shown in the figure) and a second ring buckle 501. For example, the second ring buckle 501 can be a concave structure arranged around the outer circumference of the directional boot 500.

It should be noted that the first screw thread 401 and the second screw thread can be screw connected with each other. The first buckle 402 and the second buckle 501 can achieve a gap fit connection, leaving a misalignment space (i.e. the bending space) between the two.

Figure 6A:
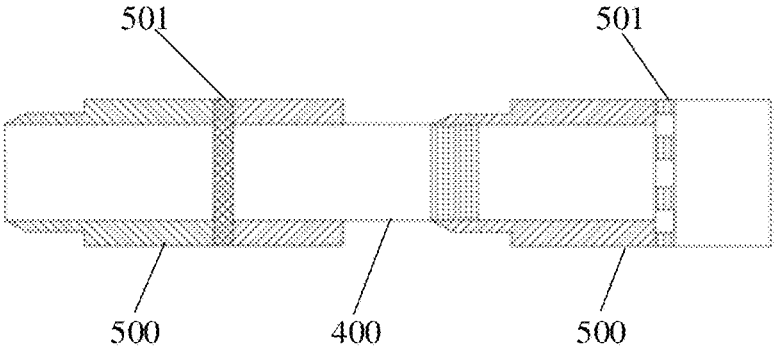
FIG. 6A is a schematic diagram illustrating connections between the drill rods and the directional boots according to an example of the present disclosure.

Next, examples of connections between the drill rods 400 and the directional boots 500 would be discussed. FIG. 6A is a schematic diagram shows connections between the drill rods and the directional boots according to an example of the present disclosure. FIG. 6A shows two directional boots 500 and one drill rod 400. The first buckle of the drill rod 400 and the second buckle 501 of one directional boot 500 can be connected in a gap fit. The drill rod 400 can rotate at a certain angle relative to the directional boots 500. As shown in FIG. 6C, when multiple drill rods 400 rotate in a same direction under an external force, the rigid bending wedge deflection tool may further bend on the basis of the initial bending curvature. The first screw thread of the drill rod 400 and the second screw thread of the directional boot 500 are matched to achieve a screw connection.

Figure 6B:
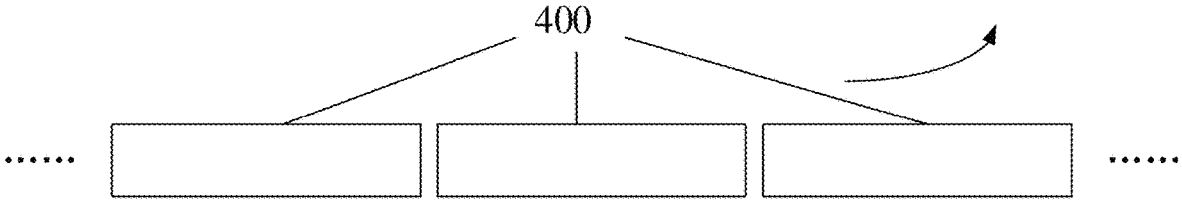
FIG. 6B is a schematic diagram illustrating position relationships of multiple drill rods without any external forces according to an example of the present disclosure.
Figure 6C:
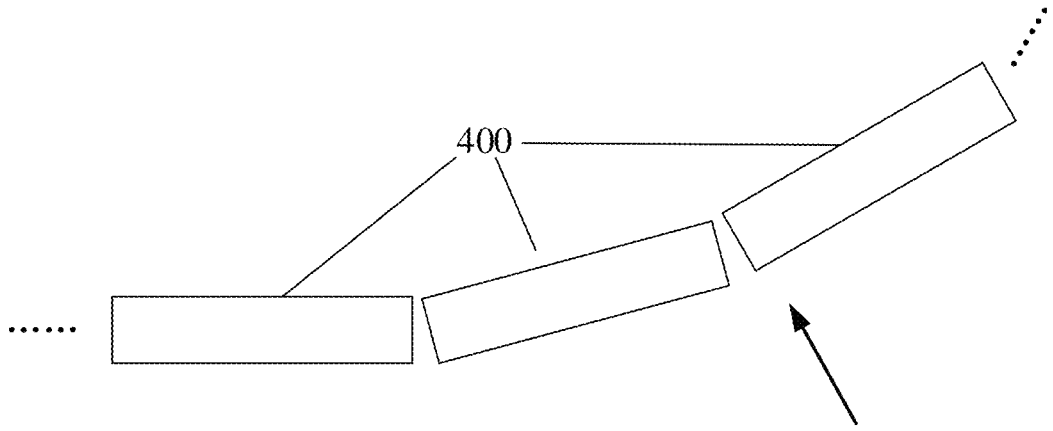
FIG. 6C is a schematic diagram illustrating position relationships of multiple drill rods with an external force according to an example of the present disclosure.

FIG. 6B is a schematic diagram illustrating position relationships of multiple drill rods without any external forces according to an example of the present disclosure. FIG. 6C is a schematic diagram illustrating position relationships of multiple drill rods with an external force according to an example of the present disclosure. Three drill rods 400 are shown in FIGS. 6B and 6C. FIG. 6B represents initial states of the drill rods 400. There can be a certain angle between adjacent drill rods 400 to form the initial curvature of the rigid bending wedge deflection tool represented by the arrow in FIG. 6B. Moreover, the bending direction of the initial curvature is consistent with the direction of the external force represented by the arrow in FIG. 6C. As shown in FIG. 6C, under the action of an external force, the drill rods 400 may further rotate in a direction deviating from the axis to further bend on the basis of the initial curvature. In examples of the present disclosure, the external force may come from the wedge deflection tool 306. The wedge deflection tool 306 may compress the bendable outer wall 312 under the action from the wall of the borehole, and the bendable outer wall 312 may further compress the drill rods 400 to bend the rigid bending unit.

It should be noted that the directional boots are not shown in FIGS. 6B and 6C.

It can be seen that in examples of the present disclosure, the reaction force from the formation received by the rigid bending unit can be released in the bending space formed in the directional boots. In this way, the pressure of the reaction force on the drill rods can be greatly reduced. Therefore, requirements on the tolerance of the drill rods can be greatly lowered. Thus, a selection range of drill rods can be extended and costs of inclination can be further reduced.

In some examples, as shown in FIG. 3A, the rigid bending unit may further include a first guide sleeve 302 and a second guide sleeve 307. Optionally, the first guide sleeve 302 may correspond to the first conversion joint 301, and the second guide sleeve 307 may correspond to the second conversion joint 310. For example, the first guide sleeve 302 may be set on the outer side of the first conversion joint 301, and the second guide sleeve 307 may be set near or on the outer side of the second conversion joint 310.

Furthermore, the first guide sleeve 302 may include a positioning component to monitor the position of the rigid bending unit and the second guide sleeve 307 may also include a positioning component to monitor the position of the rigid bending unit. In this way, the position of the rigid bending unit can be monitored and reported in real-time. Thus, charts of the drill rods, such as a curvature chart of the drill rods or a trajectory chart of the drill rods can be constructed. For example, the positioning components can be embedded monitoring devices.

In some examples, as shown in FIG. 3A, the rigid bending unit may further include a baffle 305. The baffle 305 may be set between the drill rods 303 and the bendable outer wall 312 to reduce a risk of sinusoidal or helical buckling of the drill rods. Optionally, the baffle 305 may be a semi-circular thin-walled plate.

In some examples, sealing rings, such as embedded sealing rings, may be provided at contact points between the directional boots 304 and the outer wall of the drill rods 303, as well as between the second conversion joint 310 and the outer wall of the drill rods 303. Optionally, the sealing ring can be an "O"-shaped sealing ring.

In some examples, as shown in FIG. 7, the drill bit 311 may include drainage holes 313 and a cone. The drainage holes 313 are distributed in a circular pattern at grooves of the cone. In this way, liquids can be discharged from the drill bit 311 easily.

Figure 8:
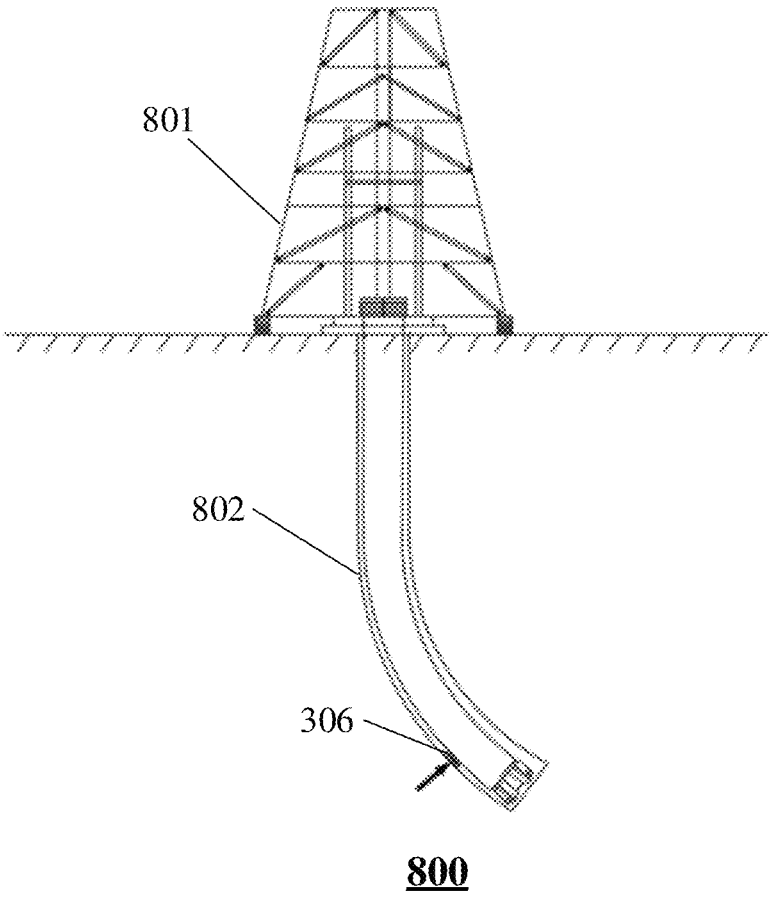
FIG. 8 is a diagram illustrating an application scenario of the directional drilling according to an example of the present disclosure.

In some examples, as shown in FIG. 8, the directional drilling device may also include a top drive unit 801. The top drive unit 801 may apply an axial propulsion force to the rigid bending unit. It should be noted that the axial propulsion force can be transmitted to the rigid bending unit through extension rods, the screw drill, etc.

Based on a same concept, the present disclosure also provides a drilling method corresponding to any of the aforementioned examples. To be noted, the drilling method can be used for aquifer remediations of a coal seam roof. FIG. 8 is a diagram illustrating an application scenario of the directional drilling device according to an example of the present disclosure. The drilling method of the directional drilling device provided in this disclosure would be described in detail based on the application scenario 800 shown in FIG. 8.

As shown in FIG. 8, the drilling method may include the following steps.

At first, a hardness of a formation in an inclined section can be determined based on geological data.

Further, a size of the wedge deflection tool 306 can be determined based on the hardness and a target curvature radius of the inclined section.

Here, the size of the wedge deflection tool 306 mainly refers to the thickness of the wedge deflection tool 306. It should be noted that the curvature of the inclined section can be pre-set, which is not limited in this disclosure.

To be noted, on one hand, the greater the hardness is, the thicker the wedge deflection tool 306 is. That is because, a thicker wedge deflection tool 306 may result in a greater distance between the extension surface and the axis of the rigid bending unit. Therefore, a stronger reaction force may be received from the wall of the borehole 802 which is needed to ensure that the reaction force can meet the mechanical requirements for a further bending of the rigid bending unit in high hardness formations. On the contrary, the smaller the hardness is, the thinner the wedge deflection tool 306 is. That is because, a thinner wedge deflection tool 306 may result in a smaller distance between the extension surface and the axis of the rigid bending unit. Therefore, a smaller reaction force may be received from the wall of the borehole 802 which is needed to ensure that the reaction force can meet the mechanical requirements for a further bending of the rigid bending unit in low hardness formations.

One the other hand, the smaller a target curvature radius of the inclined section is, the thicker the wedge deflection tool 306 is. That is because, a strong reaction force may be needed to meet the mechanical requirements for a further bending of the rigid bending unit while the target curvature radius of the inclined section is small. Moreover, the greater the target curvature radius of the inclined section is, the thinner the wedge deflection tool 306 is. That is because, a small reaction force may be needed to meet the mechanical requirements for a further bending of the rigid bending unit while the target curvature radius of the inclined section is big.

For example, when the rock layer in the inclined section is hard rock and the target curvature radius of the inclined section is small, the wedge deflection tool 306 may be subjected to a strong reaction force. Therefore, a thicker wedge deflection tool 306 should be selected. When the rock layer in the inclined section is soft rock and a large target curvature radius of the inclined section is required, a thinner wedge deflection tool 306 should be selected for the wedge deflection tool 306 may be subjected to a small reaction force. In some examples of the present disclosure, relationships between the thickness of the wedge deflection tool 306, the hardness of the formation of the inclined section and target curvature radius of the inclined section can be predefined. Thus, the thickness of the wedge deflection tool can be directly determined based on the hardness and the target curvature radius based on the relationships preset.

In response to determining the directional drilling device has reached a lateral drilling point, activating the power unit.

After the power unit is started, high-pressure water would be transported to the screw drill 200 through a continuous pipe. Further, the transmission core shaft may drive the drill bit 311 to rotate and cut the rock mass. Due to the initial curvature of the rigid bending unit, the drilling direction of the drill bit 311 may deviate from the vertical borehole.

Then, activating the top drive unit 801 of the directional drilling device to provide a propulsion force to the rigid bending unit.

In this way, the bending degree of the rigid bending unit can be adjusted by the wedge deflection tool 306 under an action of the propulsion force and a reaction force from the contact surface of the formation (i.e. the wall of the borehole 802).

It should be noted that the wedge deflection tool 306 is a force integrator. The wedge deflection tool 306 is subjected to the driving force of the drill rod and the reaction force from the contact surface of the formation, then changes the drilling trajectory and gradually changes the drilling direction from a vertical slight tilt direction to a horizontal direction.

In some examples, the drilling trajectory can be transmitted in real-time by the first guide sleeve 302 and the second guide sleeve 307. The drilling direction can be monitored by the surface scale of the drill rod. When the drill rod is horizontal, the drilling process can be stopped.

In some examples, the bending degree of the rigid bending unit can be controlled by adjusting the propulsion force provided by the top driving unit 801. In this way, a precise control on the curvature of the inclined section can be achieved. For example, when an actual curvature radius of the inclined section is smaller than the target curvature radius, the propulsion force provided by the top driving unit 801 on the drill rod 303 should be reduced (this propulsion force also acts on the wedge deflection tool 306), so that the direction of a combined force of the propulsion force and the reaction force on the wedge deflection tool 306 would be closer to the vertical axis direction of the drill rod. On the contrary, when an actual curvature radius of the inclined section is larger than the target curvature radius, the propulsion force of the top driving unit 801 on the drill rod 303 should be increased.

It should be noted that the actual curvature can be determined using the positioning components of the first guide sleeve 302 and the second guide sleeve 307. Specific methods of curvature determination may be conducted based on a specific type, a model, etc. of the positioning components, which will not be limited by this disclosure.

It can be seen from the above description, the directional drilling device and drilling method provided in the disclosed examples do not need any additional lateral motors. Through such a simple structure of the directional drilling device, the opening of a lateral branch hole in a vertical borehole can be realized without casing or window opening. It has advantages such as a simple device structure, low costs, and convenient operations, etc. In addition, the technical solution of the disclosure can be used for high curvature side drilling, which can meet the technical requirements for horizontal drilling within a curvature radius range of 3 m to 20 m. The difficulties on adjusting the curvature radius of the inclined section and the difficulties on controlling a drilling trajectory can be solved. Moreover, high flexibility requirements of drilling tools can be met.

The present disclosure also provides a directional drilling device which can control a curvature of an inclined section in a vertical borehole. As shown in FIG. 3A, the directional drilling device may include the following components: a drill bit 311; a power unit 210 for providing a rotary power to the drill bit 311; a rigid bending unit, set between the drill bit 311 and the power unit 210, for bending on a basis of an initial curvature under an external force; a bendable outer wall 312, set on an outer side of the power unit 210 and the rigid bending unit; and a wedge deflection tool 306, set at one end of the bendable outer wall 312 near the drill bit 311, for receiving a reaction force perpendicular to an axial direction of the bendable outer wall 312 from a wall of the borehole and bending the rigid bending unit.

In some examples, the wedge deflection tool 306 may protrude outward relative to the bendable outer wall 312. In some examples, the position of the wedge deflection tool 306 may deviate from a bending direction of the initial curvature.

In some examples, the rigid bending unit may include: a first conversion joint 301 for connecting the drill bit 311; and a second conversion joint 310 for connecting the power unit 210.

In some examples, the rigid bending unit may include: a first guide sleeve 302 corresponding to the first conversion joint 301 and a second guide sleeve 307 corresponding the second conversion joint 302. The first guide sleeve 302 and the second guide sleeve 307 may include a positioning component respectively for monitoring the position of the rigid bending unit.

In some examples, the rigid bending unit may include: drill rods 303; and directional boots 304, for connecting two adjacent drill rods 303 and providing a bending space between the two adjacent drill rods 303.

In some examples, the rigid bending unit may further include a baffle 305. The baffle 305 may be set between the drill rods 303 and the bendable outer wall 312.

In some examples, as shown in FIGS. 5A, 5B, and 6A, the directional boot 500 may include a screw thread and a ring buckle 501 with a bending space. Wherein, the screw thread connects to a tail end of a drill rod, and the ring buckle 501 connects to a head end of the drill rod.

In some examples, as shown in FIGS. 2 and 3A, the power unit 210 may include a screw drill 200 and a transmission sleeve 206. Wherein, the transmission sleeve 206 connects to the screw drill 200 and the rigid bending unit. It should be noted that the screw drill 200 can be replaced with another component that can provide the rotary power. The present disclosure does not limit the structure of the screw drill 200.

In some examples, a distance between an outer surface of the wedge deflection tool (that is, the extension surface) and an outer surface of the bendable outer wall can be determined based on a hardness of a formation to be drilled and/or a curvature of the inclined section.

The present disclosure also provides a drilling method of the directional drilling device disclosed. The drilling method may include the following steps:

- determining a hardness of a formation in an inclined section based on geological data;
- determining a size of the wedge deflection tool based on the hardness and a curvature of the inclined section;
- in response to determining the directional drilling device has reached a lateral drilling point, activating the power unit;
- activating the top drive unit of the directional drilling device to provide a propulsion force to the rigid bending unit; and
- adjusting a bending degree of the rigid bending unit by the wedge deflection tool under an action of the propulsion force and a reaction force from a contact surface of the formation.

Those of ordinary skill in the art should appreciate that the discussion on any one of the foregoing examples is merely exemplary, but is not intended to imply that the scope of the present disclosure (including the claims) is limited to these examples. Under the idea of the present disclosure, the technical features of the foregoing examples or different examples may be combined, the steps may be implemented in any order, and there are many other variations in different aspects of the examples of the present disclosure, all of which are not provided in detail for simplicity.

Besides, for the sake of simplifying description and discussion and not making the examples of the present disclosure difficult to understand, the provided drawings may show or not show the public power supply/earthing connection to an integrated circuit (IC) chip and other parts. Besides, the device may be shown in block diagram form to prevent the examples of the present disclosure from being difficult, and moreover, this considers the following facts, that is, the details of the implementations with regard to the devices in these block diagrams highly depend on the platform which will implement the examples of the present disclosure (that is, these details should be completely within the scope understood by those skilled in the art). Where specific details (e.g. circuits) are set forth in order to describe exemplary examples of the present disclosure, it should be apparent to those skilled in the art that the examples of the present disclosure can be practiced without, or with variation of, these specific details. Therefore, these descriptions shall be considered to be illustrative instead of restrictive thereto. Therefore, these descriptions shall be considered to be illustrative instead of restrictive thereto.

While the present disclosure has been described in conjunction with specific examples thereof, many alternatives, modifications and variations of such examples will be apparent to those of ordinary skill in the art in light of the foregoing description. For example, other memory, such as dynamic RAM (DRAM), may use the examples discussed.

The examples of the disclosure are intended to embrace all such alternatives, modifications, and variations as to fall within the broad scope of the appended claims. Therefore, any omission, modification, equivalent replacement and improvement made within the spirits and principles of the examples of the present disclosure shall fall within the protection scope of the present disclosure.

What is claimed is:

1. A curvature controllable directional drilling device, comprising:

a drill bit;

a power unit for providing a rotary power to the drill bit; wherein, the power unit comprises: a screw drill and a transmission sleeve;

a rigid bending unit, set between the drill bit and the power unit, for bending on a basis of an initial curvature under an external force; wherein, the transmission sleeve connects to the screw drill and the rigid bending unit;

a bendable outer wall, set on an outer side of the power unit and the rigid bending unit; and a wedge deflection tool, set at one end of the bendable outer wall near the drill bit, for receiving a reaction force perpendicular to an axial direction of the bendable outer wall from a wall of a borehole and bending the rigid bending unit; wherein, a position of the wedge deflection tool deviates from a bending direction of the initial curvature; wherein the rigid bending unit comprises:

a first conversion joint and a second conversion joint, wherein, the first conversion joint connects to the power unit and the second conversion joint connects to the drill bit;

a first guide sleeve and a second guide sleeve corresponding to the first conversion joint and the second conversion joint respectively; the first guide sleeve and the second guide sleeve respectively comprising a positioning component for monitoring a position of the rigid bending unit;

a plurality of drill rods located between the first conversion joint and the second conversion joint; and directional boots, for connecting two adjacent drill rods and providing a bending space between the two adjacent drill rods; wherein, the directional boot comprises a screw thread and a ring buckle with the bending space; the screw thread connects to a tail end of the drill rod; and the ring buckle connects to a head end of the drill rod.

2. The directional drilling device according to claim 1, wherein, the wedge deflection tool protrudes outward relative to the bendable outer wall.

3. The directional drilling device according to claim 1, further comprising:

a baffle, set between the drill rods and the bendable outer wall.

4. The directional drilling device according to claim 1, further comprising:

a top drive unit, for providing a propulsion force to the rigid bending unit.

5. The directional drilling device according to claim 1, wherein, a distance between an outer surface of the wedge deflection tool and an outer surface of the bendable outer wall is determined based on a hardness of a formation to be drilled.

6. A drilling method of the directional drilling device according to claim 1, comprising:

determining a hardness of a formation in an inclined section based on geological data; determining a size of a wedge deflection tool of the directional drilling device based on the hardness and a target curvature radius of the inclined section;

in response to determining the directional drilling device has reached a lateral drilling point, activating the power unit; and activating a top drive unit of the directional drilling device to provide a propulsion force to the rigid bending unit; adjusting a bending degree of the rigid bending unit by the wedge deflection tool under an action of the propulsion force and a reaction force from a contact surface of the formation.

* * * * *